US010890386B2

(12) United States Patent
Kent et al.

(10) Patent No.: US 10,890,386 B2
(45) Date of Patent: Jan. 12, 2021

(54) EVAPORATOR UNIT INCLUDING DISTRIBUTOR TUBE AND METHOD THEREOF

(71) Applicant: MAHLE International GmbH, Stuttgart (DE)

(72) Inventors: Scott Edward Kent, Albion, NY (US); Bruce William Dittly, Tonawanda, NY (US)

(73) Assignee: MAHLE International GmbH, Stuttgart (DE)

( * ) Notice: Subject to any disclaimer, the term of this patent is extended or adjusted under 35 U.S.C. 154(b) by 131 days.

(21) Appl. No.: 16/265,202

(22) Filed: Feb. 1, 2019

(65) Prior Publication Data

US 2020/0248974 A1 Aug. 6, 2020

(51) Int. Cl.

| | |
|---|---|
| ***F28F 9/02*** | (2006.01) |
| ***F28F 9/18*** | (2006.01) |
| ***F25B 39/00*** | (2006.01) |
| ***F25B 39/02*** | (2006.01) |

(52) U.S. Cl.

CPC ..... *F28F 9/0273* (2013.01); *F25B 39/00* (2013.01); *F25B 39/028* (2013.01); *F28F 9/18* (2013.01)

(58) Field of Classification Search

CPC ... F28F 9/0273; F28F 9/18; F25B 9/00; F25B 9/028

See application file for complete search history.

(56) References Cited

U.S. PATENT DOCUMENTS

| | | | | |
|---|---|---|---|---|
| 4,005,593 | A * | 2/1977 | Goldberg | B21D 7/06 72/213 |
| 2004/0226705 | A1* | 11/2004 | Hiyama | F28F 9/0243 165/172 |
| 2011/0290465 | A1* | 12/2011 | Joshi | F28F 9/0273 165/175 |
| 2013/0125578 | A1* | 5/2013 | Lee | F25B 13/00 62/498 |
| 2013/0168070 | A1* | 7/2013 | Samuelson | F28F 9/0131 165/174 |
| 2016/0076819 | A1* | 3/2016 | Espersen | F28D 15/0266 165/104.21 |
| 2018/0135915 | A1* | 5/2018 | Kester | F28F 9/0275 |

* cited by examiner

*Primary Examiner* — Marc E Norman
(74) *Attorney, Agent, or Firm* — Dickinson Wright PLLC

(57) ABSTRACT

An evaporator for an air conditioning system includes an inlet manifold, an outlet manifold and a plurality of refrigerant tubes. The refrigerant tubes hydraulically communicate with the inlet manifold and the outlet manifold for a refrigerant flow. The inlet manifold includes a distributor tube with a plurality of orifices for equally aliquoting two phase refrigerant inside the inlet manifold. A mandrel is provided inside the distributor tube and a portion of the distributor tube with the inserted mandrel is flattened and bent toward an inlet port of the distributor tube for fitting the distributor tube within the inlet manifold. The mandrel is inserted into the distributor tube for preventing the distributor tube from collapsing when the distributor tube is flattened and bent.

19 Claims, 4 Drawing Sheets

EVAPORATOR UNIT INCLUDING DISTRIBUTOR TUBE AND METHOD THEREOF

FIELD

The present disclosure relates to an evaporator for an air conditioning system, and more particularly relates to refrigerant distribution in the evaporator including a multi-pass and multi-directional flow distributor for the air conditioning system, for example in a vehicle.

BACKGROUND

An air conditioning system, for example in a motor vehicle, includes a refrigerant loop having an evaporator located within a heating, ventilation, and air conditioning (HVAC) system for supplying conditioned air to the passenger compartment of the vehicle, an expansion device located upstream of the evaporator, a condenser located upstream of the expansion device in front of the engine compartment, and a compressor located within the engine compartment upstream of the condenser. The above-mentioned components are hydraulically connected in series within a closed refrigerant loop. In other examples, however, the air conditioning system may be used in a commercial or residential area.

The HVAC system relies on the evaporator to provide cooled and dehumidified air to the space in which persons are staying for the person's comfort and, in the case of an automotive use, for keeping the windshield from fogging. Starting from the inlet of the evaporator, a low pressure two phase refrigerant enters the evaporator as a mixture of liquid and vapor and flows through the tubes of the evaporator where it expands into a low pressure vapor refrigerant by absorbing heat from an incoming air stream. The evaporator requires even refrigerant distribution for optimum performance.

A conventional evaporator generally includes an inlet manifold, an outlet manifold, and a plurality of tubes hydraulically connecting the manifolds. Additionally, there may be one or more intermediate manifolds, such as a return manifold, between the inlet manifold and outlet manifold. As described above, it is desirable to be able to aliquot, break into equal parts, the two phase refrigerant to the refrigerant tubes of the evaporator to provide uniform cooling of the airstream. However, when two phase refrigerant enters the inlet manifold at a relatively high or low velocity, this results in the misaliquoting of the refrigerant flowing through the refrigerant tube causing degradation in the heat transfer efficiency of the evaporator.

SUMMARY

It is the object of the present application to provide an evaporator including a distributor in an air conditioning system.

According to one aspect of the present disclosure, the evaporator for the air conditioning system includes an inlet manifold receiving a refrigerant, an outlet manifold discharging the refrigerant, a plurality of refrigerant tubes hydraulically communicating with the inlet manifold and the outlet manifold for the refrigerant flow, and a distributor tube located within the inlet manifold for aliquoting the refrigerant. The inlet manifold includes a plurality of inlet slots for inserting the refrigerant tubes of the evaporator. A portion of the distributor tube is flattened and bent toward an inlet port of the distributor tube along a longitudinal axis. In addition, a mandrel is inserted in the distributor tube for preventing the distributor tube from collapsing when the distributor tube is flattened and bent.

The distributor tube includes the inlet port hydraulically connected to an expansion valve, a distal end located at an opposite end of the inlet port, and an open end bent toward the inlet port and extended to a middle area between the distal end and the inlet port along the longitudinal axis.

According to a further aspect of the present disclosure, the distributor tube is formed as a tubular section and a flattened section, and includes a transitional section from the tubular section to the flattened section. Tubular section of the distributor tube is formed from the inlet port to the transitional section, and the flattened section of the distributor tube is formed from the transitional section to the open end.

According to a further aspect of the present disclosure, the portion of the distributor tube with the inserted mandrel is flattened and bent such that the inserted mandrel is permanently installed in the flattened section of the distributor tube. The mandrel further extends into the tubular section from the flattened section for preventing the inserted mandrel from blocking the refrigerant flow into the flattened section of the distributor tube.

According to a further aspect of the present disclosure, the distributor tube with the inserted mandrel is bent toward the inlet port of the distributor tube by 180 degrees along the longitudinal axis.

According to a further aspect of the present disclosure, the mandrel is formed as a hairpin shape including a pair of legs with a curved portion. The pair of legs of the mandrel are configured to keep a continuous open channel between the two legs inside the flattened section of the distributor tube for the refrigerant flow.

According to a further aspect of the present disclosure, a longitudinal length of the mandrel is longer than a longitudinal length of the flattened section of the distributor tube along the longitudinal axis. A diameter of the mandrel wire is equal to or less than an internal clearance of a channel formed by the flattened section of the distributor tube.

According to a further aspect of the present disclosure, the distributor tube inside the inlet manifold includes a plurality of orifices for equally aliquoting the refrigerant, and the orifices of the distributor tube are oriented away from open inlet ends of the refrigerant tubes.

According to a further aspect of the present disclosure, each of open inlet ends of the plurality of refrigerant tubes extends through a corresponding one of a plurality of inlet slots on the inlet manifold, and each of open outlet ends of the plurality of refrigerant tubes extends through a corresponding one of a plurality of outlet slots on the outlet manifold. A plurality of fins are disposed between and materially joined to the refrigerant tubes for facilitating heat exchange.

According to one aspect of the present disclosure, a method of manufacturing an inlet manifold for an evaporator of an air conditioning system comprises steps of providing an inlet manifold with a plurality of inlet slots for inserting refrigerant tubes, providing a distributor tube for the inlet manifold, flattening a portion of the distributor tube, bending the flattened portion of the distributor tube toward an inlet port of the distributor tube along a longitudinal axis; and placing the distributor tube in the inlet manifold. The method further comprises a step of inserting a mandrel into the distributor tube prior to flattening for preventing the distributor tube from collapsing when the distributor tube is flattened and bent.

Further details and benefits will become apparent from the following detailed description of the appended drawings. The drawings are provided herewith purely for illustrative purposes and are not intended to limit the scope of the present disclosure.

DRAWINGS

Figure 1:
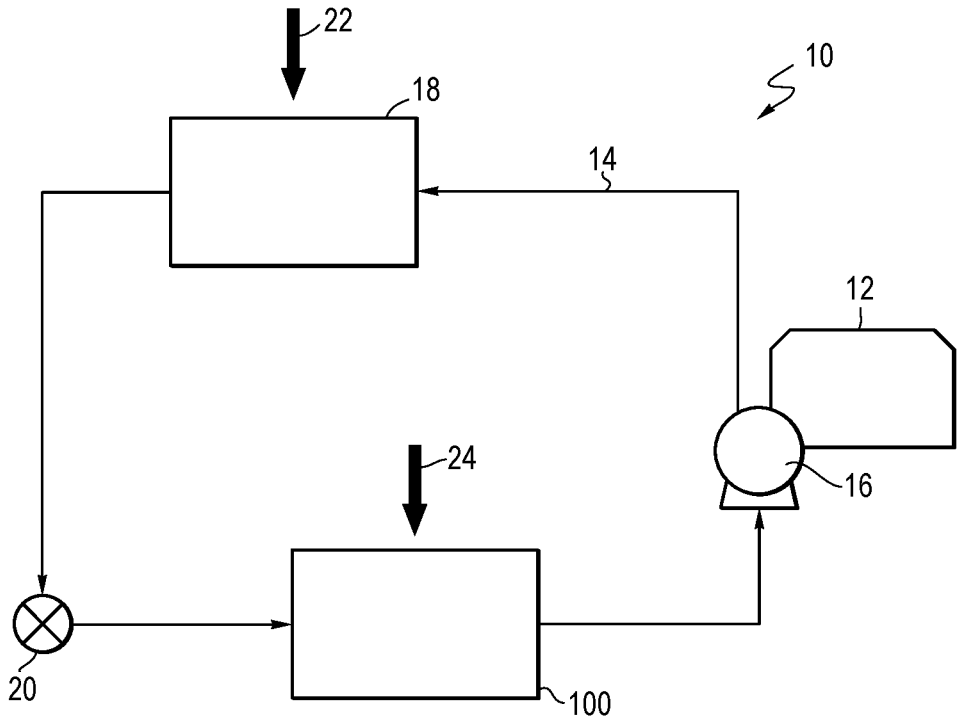
FIG. 1 shows a schematic view of an air conditioning system with an evaporator in accordance with an exemplary form of the present disclosure.

The drawings described herein are for illustration purposes only and are not intended to limit the scope of the present disclosure in any way.

DETAILED DESCRIPTION

The following description is merely exemplary in nature and is in no way intended to limit the present disclosure or its application or uses. It should be understood that throughout the drawings, corresponding reference numerals indicate like or corresponding parts and features.

FIG. 1 illustrates an air conditioning system 10 for a motor vehicle. In the example of FIG. 1, the air conditioning system 10 is shown in the vehicle having an engine 12, but the air conditioning system 10 could also be used to cool a building or any other structure. As shown in FIG. 1, the air conditioning system 10 includes a refrigerant loop 14 for cycling a refrigerant. The refrigerant loop 14 includes a compressor 16 for compressing the refrigerant to a heated gas. The compressor 16 is operably connected to the engine 12 of the vehicle. In FIG. 1, the refrigerant loop 14 includes a condenser 18 in fluid communication with the compressor 16 for receiving the heated refrigerant and for transferring heat from the refrigerant to a first flow of air 22 to condense the refrigerant to a liquid.

As shown in FIG. 1, the refrigerant loop 14 further includes an expansion valve 20 in fluid communication with the condenser 18 for receiving the liquid refrigerant and for expanding it into a cold two phase refrigerant. An evaporator 100 completes the refrigerant loop 14 and is in fluid communication with the expansion valve 20 for receiving the cold two phase refrigerant. The expansion valve 20 is configured to provide uniform refrigerant aliquoting through the evaporator 100. The evaporator 100 transfers heat from a second flow of air 24 to the refrigerant to evaporate the refrigerant to a gas and to cool the second flow of air 24 for cooling the passenger compartment of the vehicle.

Figure 2:
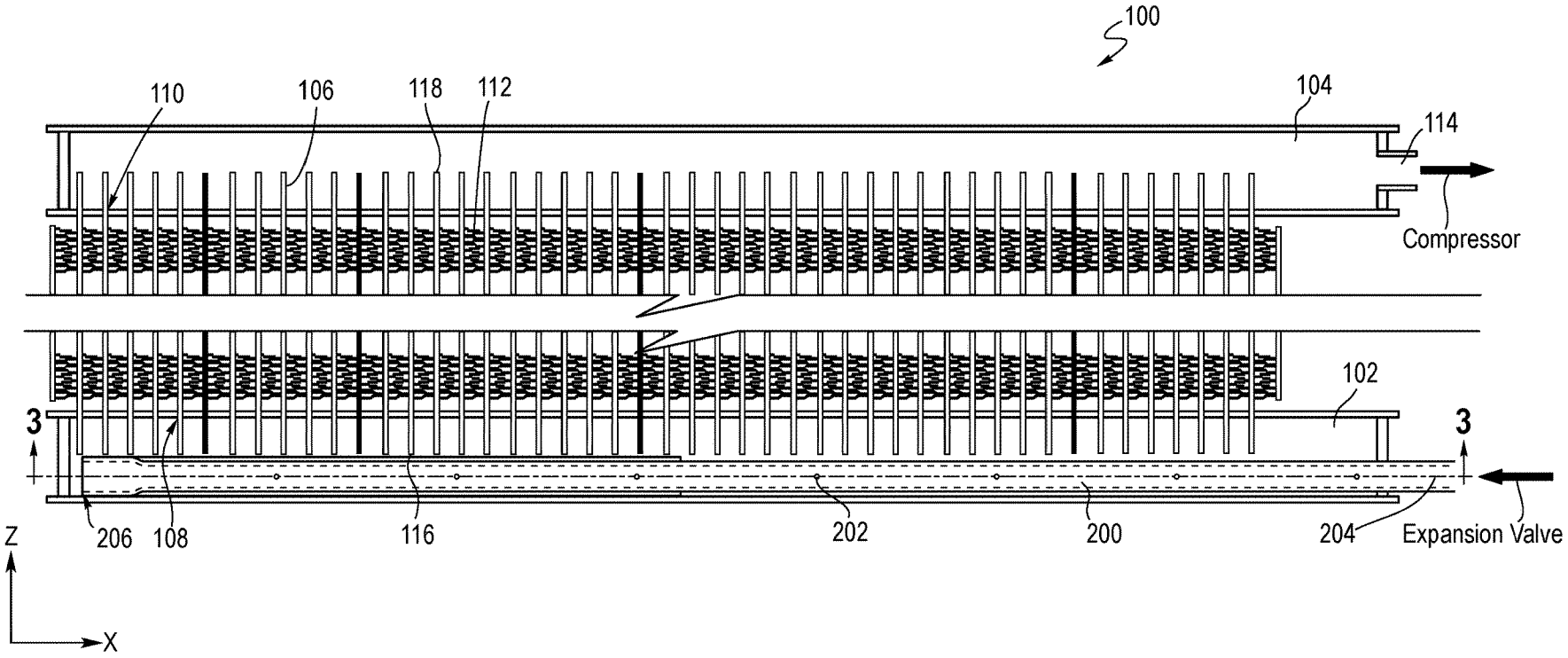
FIG. 2 is a partial front view of the evaporator of FIG. 1.

FIG. 2 illustrates a partial front view of a first example of the evaporator 100. The evaporator 100 includes an inlet manifold 102 and an outlet manifold 104 along a longitudinal axis X. The evaporator 100 further includes a plurality of refrigerant tubes 106 hydraulically connecting the manifolds 102 and 104 for the refrigerant flow from the inlet manifold 102 to the outlet manifold 104 along a vertical axis Z. The longitudinal axis X is perpendicular to the vertical axis Z. Each of the inlet slots 108 of the inlet manifold 102 and each of the outlet slots 110 of the outlet manifold 104 align with each of the refrigerant tubes 106, respectively.

As shown in FIG. 2, the refrigerant from the expansion valve 20 flows into the inlet manifold 102. The refrigerant from the inlet manifold 102 flows through the inlet slots 108, into the plurality of refrigerant tubes 106 and accepts heat from the second flow of air 24 flowing over the refrigerant tubes 106.

In FIG. 2, the evaporator 100 can also include a plurality of fins 112 having louvers disposed between the refrigerant tubes 106 to aid in heat transfer between the refrigerant and the air 24. The refrigerant tubes 106 and fins 112 are formed of a heat conductive material, preferably an aluminum alloy, assembled onto the manifolds 102 and 104 and brazed into an evaporator heat exchanger assembly. The refrigerant then flows into the outlet manifold 104 through outlet slots 110 and is directed to the compressor 16 through an outlet port 114.

Figure 3:
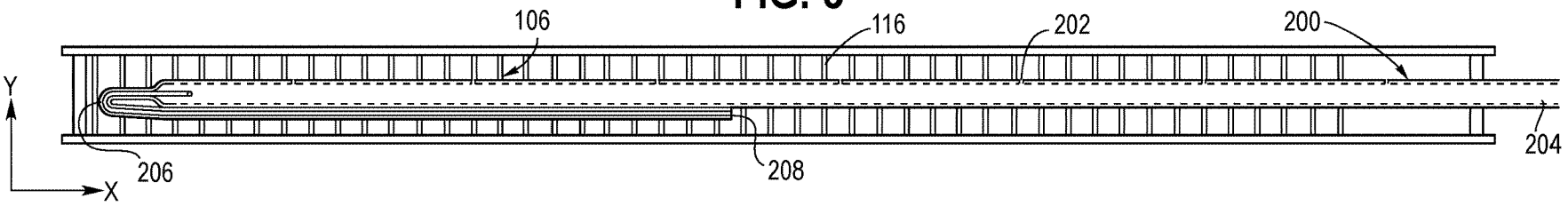
FIG. 3 is a cross-sectional view of the evaporator of FIGS. 1 and 2, taken along line 3-3 of FIG. 2.

As shown in FIGS. 2 and 3, the inlet manifold 102 includes a distributor tube 200 connected to the expansion valve 20 through an inlet port 204 of the distributor tube 200. The distributor tube 200 is disposed inside the inlet manifold 102, extending parallel with the inlet manifold 102 along the longitudinal axis X. The distributor tube 200 includes the inlet port 204 hydraulically connected to the expansion valve 20, a distal end 206 located at an opposite side of the inlet port 204 along the longitudinal axis X, and an open end 208 turned toward the inlet port of 204 of the distributor tube 200 along the longitudinal axis X. The distributor tube 200 further includes a plurality of orifices 202 arranged in a linear array parallel to the longitudinal axis X and oriented away from open inlet ends 116 of the refrigerant tubes 106. In FIGS. 2 and 3, for example, the plurality of orifices 202 are preferably oriented 90 degrees from the open inlet ends 116 of the refrigerant tubes 106. In accordance with other forms of the present disclosure, the other suitable orientation arrangements of the plurality of orifices 202 may be implemented.

In a conventional evaporator, generally, a distributor tube serves as a retention and expansion device where it retains and accumulates the mixture of two phase refrigerant until the liquid part of the incoming mixture fills the interior volume of the distributor tube before being discharged through the plurality of orifices. The orifices are appropriately sized to cause a pressure drop or a pressure build-up in the distributor tube and to reduce the separation of vapor refrigerant and liquid refrigerant in the mixture of two phase refrigerant.

An evaporator with a distributor tube has recently been developed and installed inside an inlet manifold. The distributor tube with altered hole pattern was developed for improving the distribution of the refrigerant inside the inlet manifold. In addition, a gas collector with the distributor tube is developed for improving the refrigerant distribution inside the inlet manifold, but It has been discovered that the gas collector and/or the distributor tube causes the pressure drop to affect the refrigerant distribution. Accordingly, due to the uneven refrigerant distribution, the non-uniform temperature pattern causes difficulty in maintaining a uniform vent temperature out of the HVAC module.

FIG. 3 shows a cross-sectional view of the inlet manifold 102 including the distributor tube 200 when the distributor tube 200 is installed into the inlet manifold 102 of the evaporator 100. The distributor tube 200 is formed as a multi-pass and multi-directional flow distributor tube 200 and receives a mixture of two phase refrigerant from the expansion valve 20.

Figure 4:
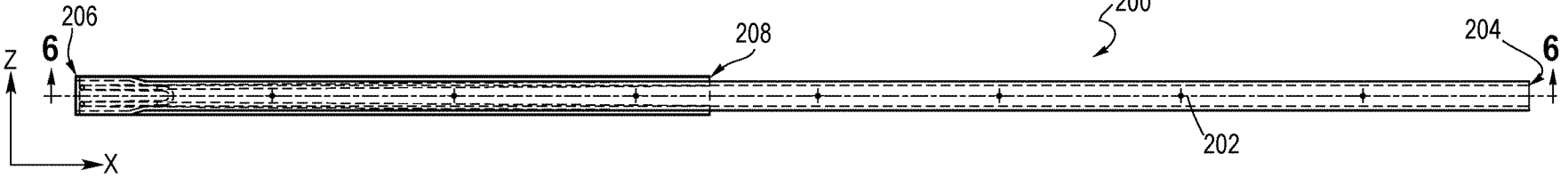
FIG. 4 is a plane view of a distributor tube shown in FIGS. 2 and 3.
Figure 5:
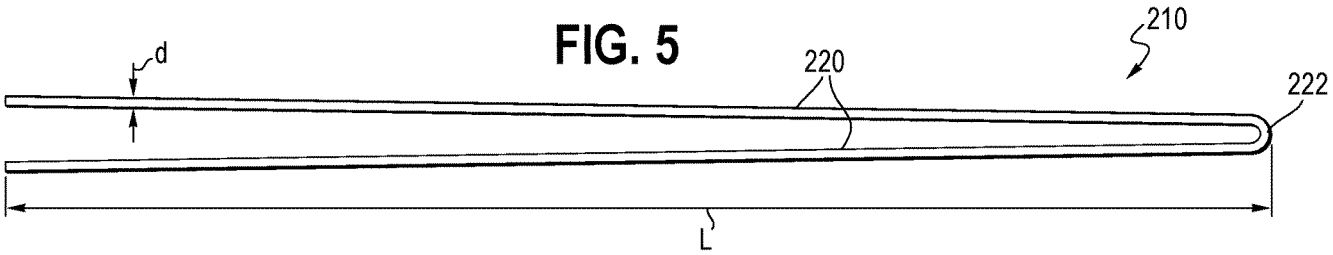
FIG. 5 is a plane view of a mandrel for use in a distributor tube according to the present disclosure.
Figure 6:
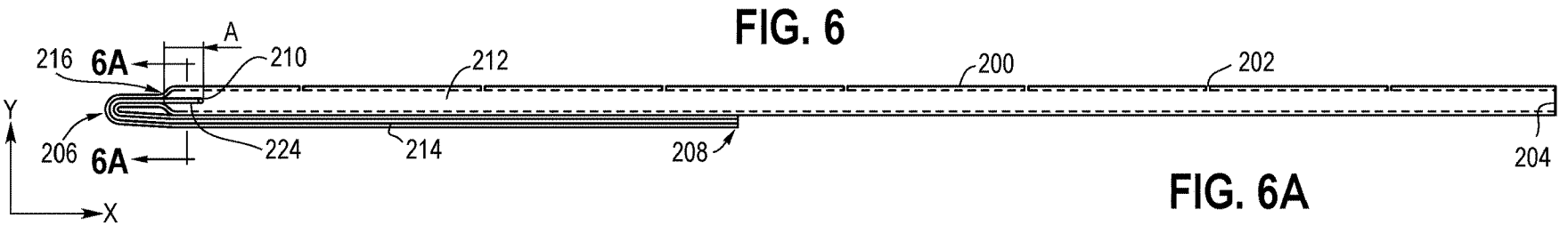
FIG. 6 is a cross-sectional view of the distributor tube, taken along line 6-6 of FIG. 4.

FIGS. 4, 5, 6 and 6A illustrate the distributor tube 200 and a mandrel 210 provided inside the distributor tube 200. FIG. 4 shows a front view of the distributor tube 200 and FIG. 6 shows a cross-sectional view of the distributor tube 200 with the mandrel 210. As shown in FIGS. 4 and 6, a portion of the distributor tube 200, in which the mandrel 210 is installed, is flattened. Accordingly, the distributor tube 200 is formed as a tubular section 212 and a flattened section 214. The flattened section 214 of the distributor tube 200 is bent at the distal end 206, which is located at the opposite side of the inlet port 204 of the distributor tube 200. As described above, before the distributor tube 200 is flattened and bent, the mandrel 210 is inserted into the distributor tube 200 for preventing the distributor tube 200 from collapsing in the flattened section 214 during the flattening and bending. By inserting the mandrel 210 into the distributor tube 200, the refrigerant flow is not blocked even though the distributor tube 200 is flattened and/or bent.

As shown in the example of FIG. 5, the mandrel 210 is formed as a hairpin shape, which includes a pair of legs 220 and a curved portion 222 connected with both legs 220. In addition, the mandrel 210 is formed as a wire with a diameter d. In accordance with other forms of the present disclosure, the mandrel 210 may be constructed of a round wire, square wire or some other cross-sectional geometries. The mandrel 210 may also be produced as a hairpin-shaped stamping of suitable thickness. A furnace-consumable material may be considered where such material will have sufficient strength for bending, consumed without plugging distribution holes and consumed without interfering with braze.

Figure 6A:
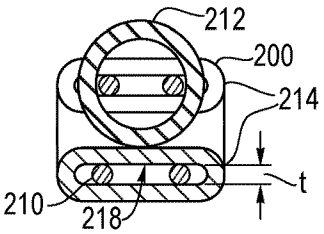
FIG. 6A is a cross-sectional view of the distributor tube, taken along line A-A of FIG. 6.

As shown in FIG. 5, for example, the diameter d of the mandrel wire 210 is preferably 1.6 mm±0.5 mm. However, the diameter of the mandrel wire 210 may be 15% 25% of the outer diameter of the distributor tube 200 in accordance with other forms of the present disclosure. As shown in FIG. 6A, the diameter d of the mandrel wire 210 is same as an internal clearance t of a channel 218 formed for the refrigerant flow in the flattened section 214 of the distributor tube 200.

As shown in FIGS. 6 and 6A, for example, the distributor tube 200 with the mandrel 210 is bent by 180 degrees at the distal end 206 toward the inlet port 204 of the distributor tube 200 along the longitudinal axis X. In accordance with other forms of the present disclosure, other suitable bended shapes of the distributor tube 200 may be implemented. After the distributor tube 200 is flattened and bent, as described above, the distributor tube 200 is formed as two different sections such as the tubular section 212 and the flattened section 214. For example, as shown in FIG. 6, the tubular section 212 is formed from the inlet port 204 to the distal end 206, and the flattened section 214 is formed from the distal end 206 to the open end 208, which is extended to a middle area between the inlet port 204 and the distal end 206. According to the present example, the longitudinal length of the flattened section 214 is equal to or less than a half of the longitudinal length of the tubular section 212 of the distributor tube 200. However, other suitable shapes and/or arrangements of the distributor tube 200 in accordance with other forms of the present disclosure may be implemented.

As shown in FIGS. 6 and 6A, as described above, the mandrel 210 is inserted into and permanently installed inside the distributor tube 200. When the distributor tube 200 with the inserted mandrel 210 is bent after flattened, the mandrel 210 including the curved portion 222 is disposed in the tubular section 212 of the distributor tube 200. However, a protruding portion 224 disposed in the tubular section 212 has a length A along the longitudinal axis X. The protruding portion 224 is configured for preventing the curved portion 222 from blocking a certain flow of the refrigerant in a transitional section 216 in which the tubular section 212 is changed to the flattened section 214. In FIG. 5, for example, the longitudinal length A of the protruding portion 224 in the tubular section 212 is preferably 12.5 mm±5.0 mm for the refrigerant to enter into the channel 218 of the flattened section 214 without any blocking of the refrigerant flow. However, the longitudinal length A of the protruding portion 224 in the tubular section 212 may need to protrude in far enough to accommodate manufacturing tolerance in order to not create a refrigerant flow obstruction in accordance with other forms of the present disclosure.

As shown in FIGS. 5 and 6, the hairpin mandrel 210 includes the pair of legs 220 for keeping a continuous open channel 218 between the two legs 220 inside the flattened section 214 of the distributor tube 200 for the refrigerant flow. In addition, the mandrel 210 is permanently placed inside the flattened section 214 of the distributor tube 200 for preventing the distributor tube 200 from collapsing. In FIG. 5, the longitudinal length L of the mandrel 210 is slightly longer than the longitudinal length of the flattened section 214 of the distributor tube 200 because the protruding portion 224 including the curved portion 222 further extended to the tubular section 212 from the flattened section 214 of the distributor tube 200 by the length A. Accordingly, the longitudinal length L of the mandrel wire 210 is longer than the longitudinal length of the flattened section 214 by the length A of the protruding portion 224. For example, the longitudinal length L of the mandrel 210 is preferably at least about 200 mm. However, the longitudinal length of the mandrel 210 may be 20%~50% of the longitudinal length of the distributor tube 200 in accordance with other forms of the present disclosure.

In FIG. 6, for example, the distributor tube 200 inside the inlet manifold 102 is bent toward the inlet port 204 of the distributor tube 200 by 180 degrees. Accordingly, as described above, the multi-pass and multi-directional flow distributor tube 200 is formed for the refrigerant flow inside the flattened and bended distributor tube 200 because the refrigerant is first flowing away from the inlet port 204 and then flowing back toward the inlet port 204. The bended distributor tube 200 with the flattened section 214 is ended at the open end 208. As described above, the open end 208 is partially or fully opened for flowing some of the refrigerant to the inlet manifold 102 through the open end 208.

By employing the multi-pass and multi-directional flow distributor tube 200, as shown in FIG. 6, maldistribution of the refrigerant in the evaporator 100 can be prevented, especially inside the inlet manifold 102. Generally, the refrigerant exiting the expansion valve 20 is in two phases and includes approximately 80% vapor and approximately 20% liquid by mass. The density of the liquid refrigerant is approximately 10~100 times greater than the density of the vapor refrigerant. Therefore, the vapor refrigerant flows faster than the liquid refrigerant. Accordingly, the multi-pass and multi-directional flow distributor tube 200 which not only provides a flow in a single direction but which directs the refrigerant back toward the inlet port 204 is configured for equally aliquoting the two phase refrigerant by an effective pressure drop inside the distributor tube 200.

Figure 8:
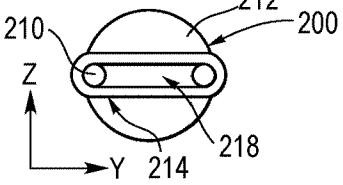
FIG. 8 is a longitudinal direction view of the flattened distributor tube with the inserted mandrel according to the example of the present disclosure.
Figure 7:
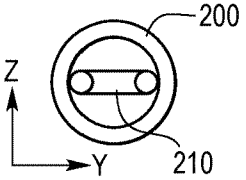
FIG. 7 is a longitudinal direction view of the distributor tube with an inserted mandrel according to an example of the present disclosure.
Figure 9:
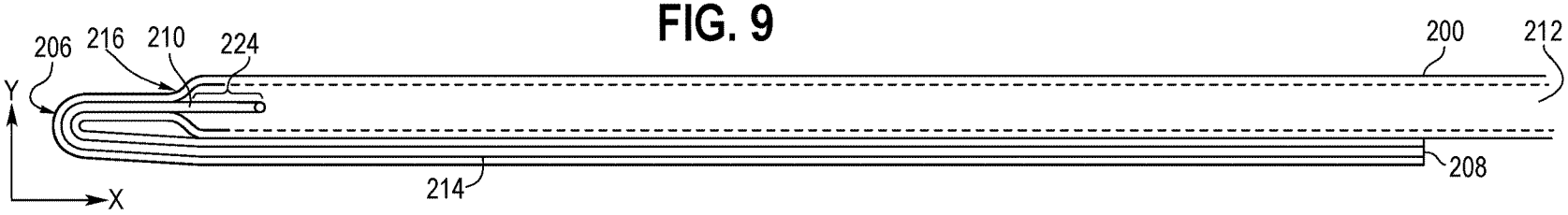
FIG. 9 is a detailed view of the bended distributor tube with the inserted mandrel according to the example of the present disclosure.

FIGS. 7 through 9 illustrate a manufacturing process of the multi-pass and multi-directional flow distributor tube 200. FIG. 7 shows a longitudinal direction view of the distributor tube 200 when the mandrel 210 is inserted into the distributor tube 200. FIG. 8 shows the longitudinal direction view of the distributor tube 200 when the distributor tube 200 with the inserted mandrel 210 is formed as the tubular section 212 and the flattened section 214. FIG. 9 shows a partial vertical direction view of the distributor tube 200 when the flattened section 214 is bent toward the inlet port 204 by 180 degrees. By the bended process of the distributor tube 200, the multi-pass and multi-directional flow distributor tube 200 is formed and the distributor tube 200 can be well fit within the typical inlet manifold 102. (See FIG. 2). As described above, the mandrel 210 is inserted into the distributor tube 200 for essentially having a zero tee bend without collapsing when the distributor tube 200 is flattened and bent because there is a limited space inside the inlet manifold 102.

As shown in FIGS. 7 through 9, it is relatively low cost to manufacture the multi-pass and multi-directional flow distributor tube 200 for equally aliquoting the two phase refrigerant inside the inlet manifold 102. By inserting the hairpin shape mandrel 210 into the distributor tube 200, the multi-pass and multi-directional flow distributor tube 200 can keep the distributor tube 200 from collapsing the flattened section 214 of the distributor tube 200 when the distributor tube 200 is flattened and bent.

While the above description constitutes the preferred embodiments of the present invention, it will be appreciated that the invention is susceptible to modification, variation and change without departing from the proper scope and fair meaning of the accompanying claims.

What is claimed is:

1. An inlet manifold for an evaporator of an air conditioning system, the inlet manifold comprising:

a plurality of inlet slots configured for inserting refrigerant tubes of the evaporator for a refrigerant flow;

a distributor tube located within the inlet manifold for aliquoting the refrigerant, a portion of the distributor tube flattened and bent toward an inlet port of the distributor tube along a longitudinal axis; and a mandrel inserted in the distributor tube for preventing the distributor tube from collapsing when the distributor tube is flattened and bent.

2. The inlet manifold of claim 1, wherein the distributor tube includes the inlet port hydraulically connected to an expansion valve, a distal end located at an opposite end of the inlet port, and an open end bent toward the inlet port and extended to a middle area between the distal end and the inlet port along the longitudinal axis.

3. The inlet manifold of claim 1, wherein the distributor tube is formed as a tubular section and a flattened section, and includes a transitional section from the tubular section to the flattened section.

4. The inlet manifold of claim 3, wherein the tubular section of the distributor tube is formed from the inlet port to the transitional section and the flattened section of the distributor tube is formed from the transitional section to an open end.

5. The inlet manifold of claim 1, wherein the portion of the distributor tube with the inserted mandrel is flattened and bent such that the inserted mandrel is permanently installed in a flattened section of the distributor tube.

6. The inlet manifold of claim 5, wherein the mandrel further extends into a tubular section from the flattened section for preventing the inserted mandrel from blocking the refrigerant flow into the flattened section of the distributor tube.

7. The inlet manifold of claim 1, wherein the distributor tube with the inserted mandrel is bent toward the inlet port of the distributor tube by 180 degrees along the longitudinal axis.

8. The inlet manifold of claim 1, wherein the mandrel is formed as a hairpin shape including a pair of legs with a curved portion.

9. The inlet manifold of claim 8, wherein the pair of legs of the mandrel are configured to keep a continuous open channel between the two legs inside a flattened section of the distributor tube for the refrigerant flow.

10. The inlet manifold of claim 1, wherein a longitudinal length of the mandrel is longer than a longitudinal length of a flattened section of the distributor tube along the longitudinal axis.

11. The inlet manifold of claim 1, wherein a diameter of the mandrel is equal to or less than an internal clearance of a channel formed by a flattened section of the distributor tube.

12. The inlet manifold of claim 1, wherein the distributor tube inside the inlet manifold includes a plurality of orifices for equally aliquoting the refrigerant, and the orifices of the distributor tube are oriented away from open inlet ends of the refrigerant tubes.

13. A method of manufacturing an inlet manifold for an evaporator of an air conditioning system, comprising steps of:

providing the inlet manifold with a plurality of inlet slots for inserting refrigerant tubes;

providing a distributor tube for the inlet manifold;

flattening a portion of the distributor tube;

bending the flattened portion of the distributor tube toward an inlet port of the distributor tube along a longitudinal axis; and placing the distributor tube in the inlet manifold.

14. The method of claim 13, wherein the method further comprises a step of inserting a mandrel into the distributor tube prior to flattening for preventing the distributor tube from collapsing when the distributor tube is flattened and bent.

15. The method of claim 14, wherein the distributor tube with the inserted mandrel is bent toward the inlet port of the distributor tube by 180 degrees in the longitudinal axis.

16. The method of claim 14, wherein the distributor tube is formed as a tubular section and a flattened section, and includes a transitional section from the tubular section to the flattened section.

17. The method of claim 16, wherein the mandrel further extends into the tubular section from the flattened section for preventing the inserted mandrel from blocking a refrigerant flow into the flattened section of the distributor tube.

18. The method of claim 16, wherein a longitudinal length of the mandrel is longer than a longitudinal length of the flattened section of the distributor tube along the longitudinal axis.

19. The method of claim 16, wherein a diameter of the mandrel is equal to or less than an internal clearance of a channel formed by the flattened section of the distributor tube.

* * * * *